US008776860B2

(12) United States Patent
Wen et al.

(10) Patent No.: US 8,776,860 B2
(45) Date of Patent: Jul. 15, 2014

(54) VANE ASSEMBLY OF VERTICAL WINDOW BLIND AND THE VANE CARRIER THEREOF

(75) Inventors: Yu-Che Wen, Guishan Township (TW); Chih-Yao Chang, Taichung (TW)

(73) Assignee: Nien Made Enterprise Co, Ltd, Taichung (TW)

( * ) Notice: Subject to any disclaimer, the term of this patent is extended or adjusted under 35 U.S.C. 154(b) by 0 days.

(21) Appl. No.: 13/453,961

(22) Filed: Apr. 23, 2012

(65) Prior Publication Data

US 2013/0014906 A1 Jan. 17, 2013

(30) Foreign Application Priority Data

Jul. 12, 2011 (CN) ..... 2011 2 0244229 U

(51) Int. Cl.
*E06B 9/36* (2006.01)
*E05D 15/06* (2006.01)

(52) U.S. Cl.
USPC ..... 160/178.1 V; 160/167 V; 160/196.1

(58) Field of Classification Search
USPC ..... 160/168.1 V, 173 V, 900, 902, 178.1 V; 24/314, 315
See application file for complete search history.

(56) References Cited

U.S. PATENT DOCUMENTS

| | | | | |
|---|---|---|---|---|
| 4,869,309 | A * | 9/1989 | Evans | 160/177 V |
| 5,996,671 | A * | 12/1999 | Anderson et al. | 160/173 V |
| 6,957,682 | B2 * | 10/2005 | Huang et al. | 160/168.1 V |
| 2001/0011581 | A1 * | 8/2001 | Welfondr | 160/166.1 |
| 2007/0137800 | A1 * | 6/2007 | Park et al. | 160/178.1 V |
| 2012/0110788 | A1 * | 5/2012 | Chen | 16/94 R |

* cited by examiner

*Primary Examiner* — Katherine Mitchell
*Assistant Examiner* — Jeremy Ramsey
(74) *Attorney, Agent, or Firm* — Tracy M. Heims; Apex Juris, PLLC

(57) ABSTRACT

A vane assembly of a vertical window covering includes a vane carrier and a vane hung thereon. The vane carrier has front wall and a rear wall with top ends connected to form a clip slot therebetween, and a hook on the rear wall in the clip slot. The hook has a slot and a slot bottom. The vane has a bore to engage the hook of the vane carrier. The slot bottom of the hook has a curved surface complementary to at least a portion of an edge of the bore to avoid damage of the vane.

9 Claims, 9 Drawing Sheets

VANE ASSEMBLY OF VERTICAL WINDOW BLIND AND THE VANE CARRIER THEREOF

BACKGROUND OF THE INVENTION

1. Field of the Invention

The present invention relates generally to a window covering, and more particularly to a vane assembly of a vertical window blind and a vane carrier of the vane assembly.

2. Description of the Related Art

FIGs. from FIG. 1 to FIG. 3 show a conventional vane assembly of a vertical window blind, including a vane carrier 2 and a vane 1 hung on the vane carrier 2. The vane 1 has an elliptical bore 1*a* and a concave side 1*b*. The vane carrier 2 is mounted on a head rail (not shown), it has a front wall 2*a* and a rear wall 2*b*, these two walls 2*a*, 2*b* are parallel and kept a distance therebetween. The vane carrier 2 further has a hook 2*c* on an inner side 2*d* of the rear wall 2*b* to engage the elliptical bore 1*a* of the vane 1.

There are some drawbacks in the conventional vane assembly, including:

1. The hook 2*c* has a flat slot bottom 2*e* to contact an edge of the elliptical bore la of the vane 1. The sharp corners of the slot bottom 2*e* may damage the vane 1 when the vane 1 swings, usually caused by wind.
2. The vane 1 will slide by wind or other external force because the slot bottom 2*e* is flat and horizontal.
3. As shown in FIG. 3, the inner side 2*d* of the rear wall 2*b* is flat also that only the sharp corners of the rear wall 2*b* contact the concave side 1*b* of the vane 1. It will damage the vane 1 as well while the vane 1 swings or slides.

SUMMARY OF THE INVENTION

The primary objective of the present invention is to provide a vane carrier of a vertical window blind, which has less risk to damage the vane hung on it.

According to the objective of the present invention, a vane carrier of a vertical window covering includes a front wall and a rear wall with top ends connected to form a clip slot therebetween; and a hook provided on the rear wall and in the clip slot. The hook has a slot and a slot bottom, and the slot bottom has a curved surface.

In an embodiment, the slot bottom of the hook slopes down towards the rear wall.

In an embodiment, the slot bottom of the hook has a flat middle portion and two curved portions at opposite sides of the middle portion.

In an embodiment, at least one of the front wall and the rear wall is provided with two curved corners.

In an embodiment, the front wall is provided with a protrusion, and the protrusion is in the clip slot and under the hook.

In an embodiment, the present invention further provides a vane carrier of a vertical window covering to hang a vane, including a front wall and a rear wall with top ends connected to form a clip slot therebetween; and a hook provided on the rear wall and in the clip slot. The hook has a slot and a slot bottom. At least one of the front wall and the rear wall is provided with two curved corners.

In an embodiment, the slot bottom of the hook has a curved surface.

In an embodiment, the slot bottom of the hook has a flat middle portion and two curved portions at opposite sides of the middle portion.

In an embodiment, the slot bottom of the hook slopes down towards the rear wall.

In an embodiment, the present invention further provides a vane assembly of a vertical window covering, including a vane carrier having front wall and a rear wall with top ends connected to form a clip slot therebetween, and a hook provided on the rear wall and in the clip slot, wherein the hook has a slot and a slot bottom; and a vane having a bore to engage the hook of the vane carrier. The slot bottom has a curved surface complementary to at least a portion of an edge of the bore.

In an embodiment, the bore of the vane is elliptical, and the slot bottom of the hook has a flat middle portion and two curved portions at opposite sides of the middle portion to fit the top edge of the bore.

In an embodiment, the vane carrier is provided with a protrusion on the front wall and under the hook, and the distance between the protrusion and the slot bottom of the hook is greater than a height of the bore of the vane.

In an embodiment, the distance between the slot bottom of the hook and a free end of the rear wall is greater than or identical to the distance between the protrusion and the slot bottom of the hook.

In an embodiment, the rear wall has two curved corners to fit a concave side of the vane.

In an embodiment, the front wall has two curved corners.

In an embodiment, the bore of the vane is round, and the slot bottom of the hook perfectly matches and contacts at least one third of a circumference of the bore.

DETAILED DESCRIPTION OF THE INVENTION

Figure 1:
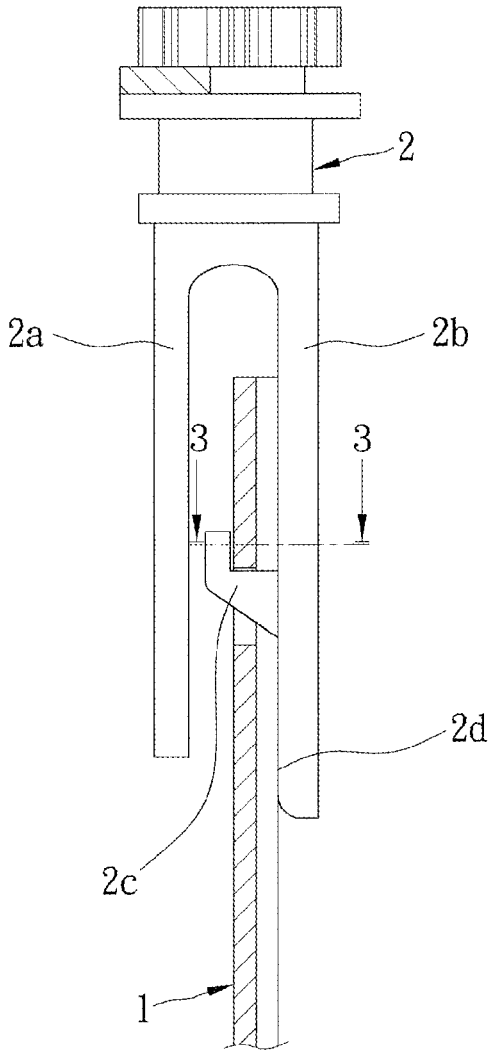
FIG. 1 (PRIOR ART)
FIG. 1 and FIG. 2 are sectional views of the conventional vane assembly.
Figure 2:
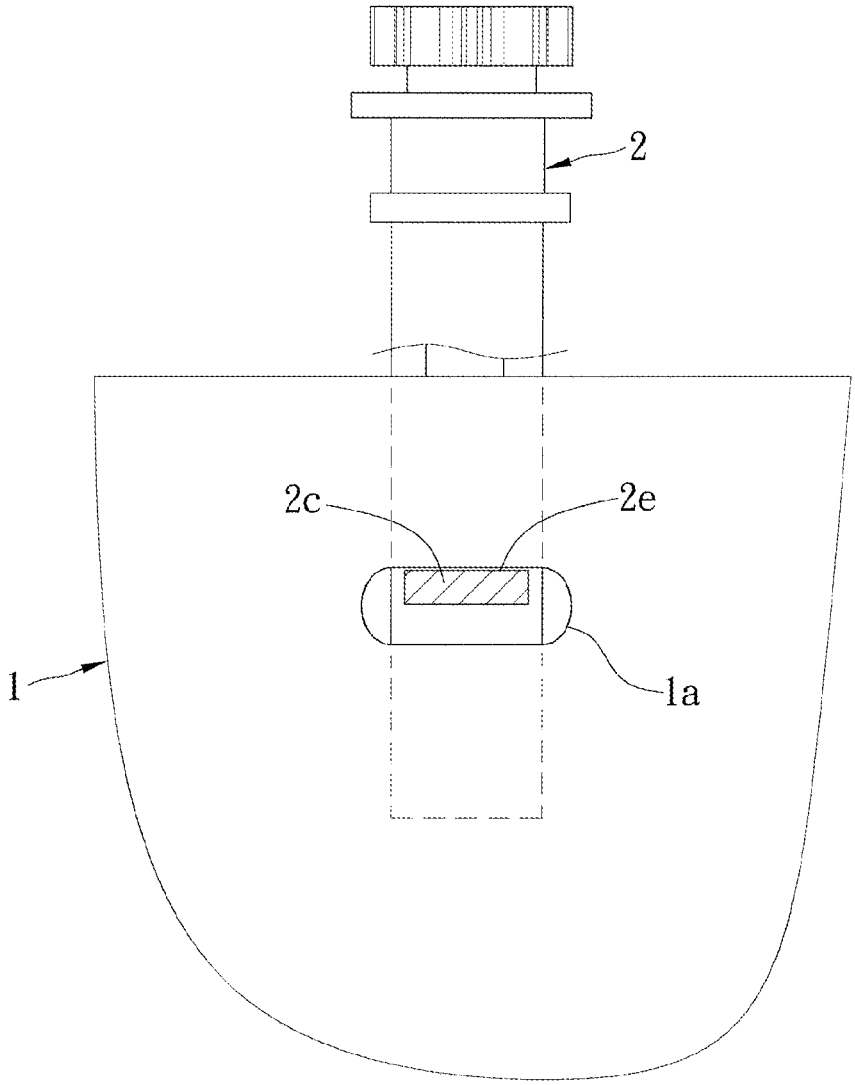
FIG. 2 (PRIOR ART)
Figure 3:
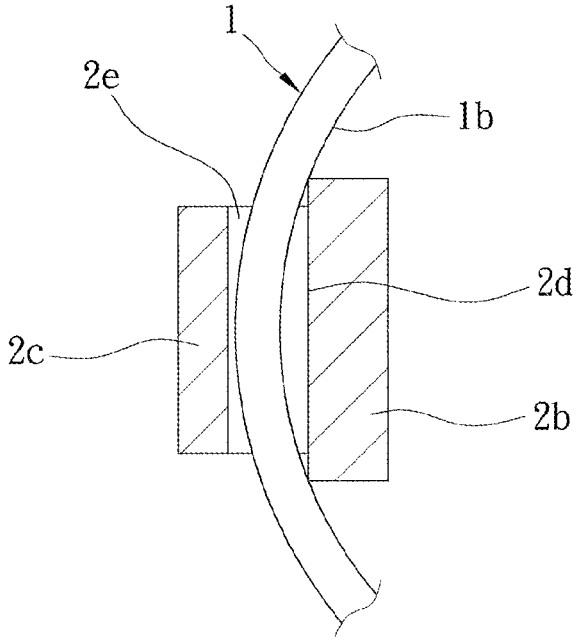
FIG. 3 (PRIOR ART)
FIG. 3 is a sectional view along the 3-3 line in FIG. 1.
Figure 4:
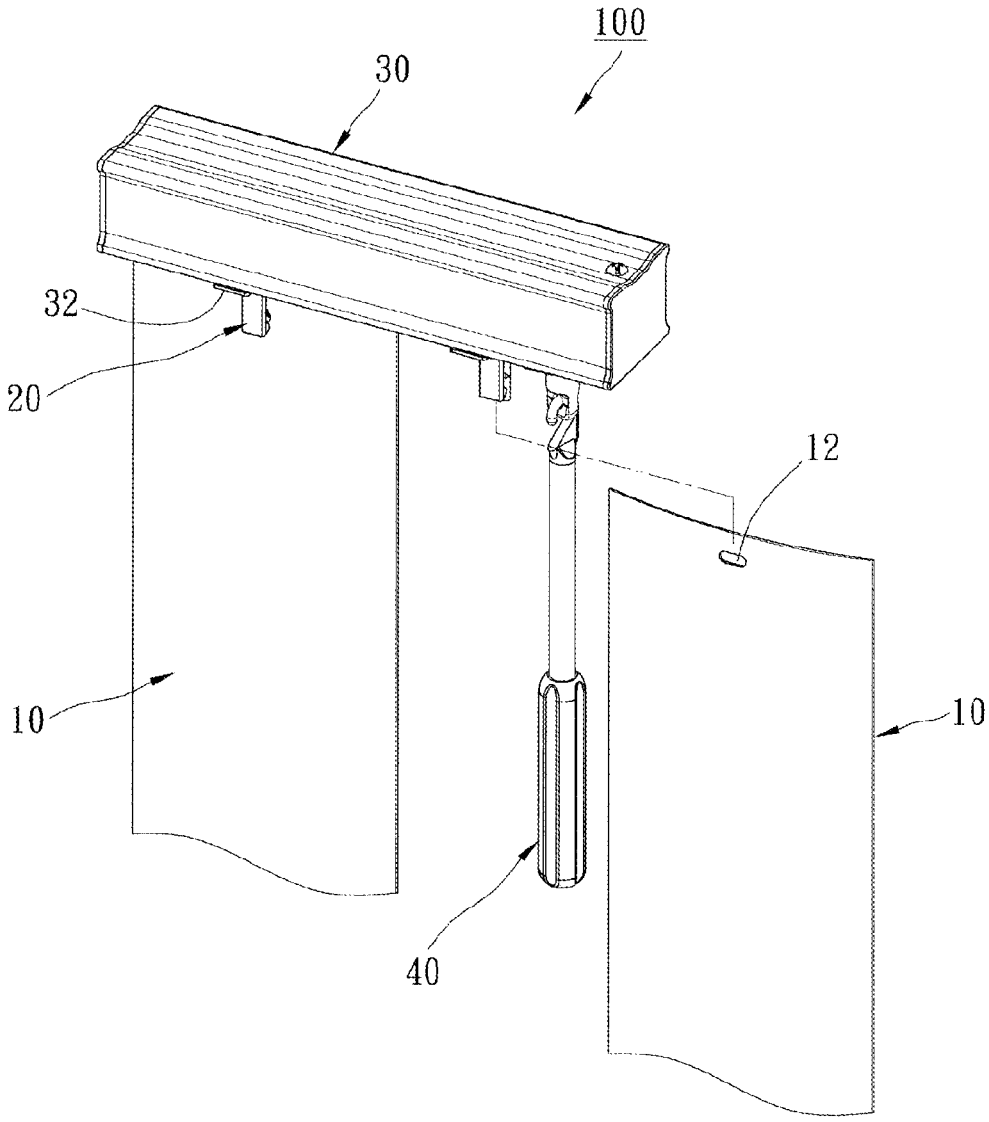
FIG. 4 is a perspective view of the vertical window blind of a first preferred embodiment of the present invention.
Figure 5:
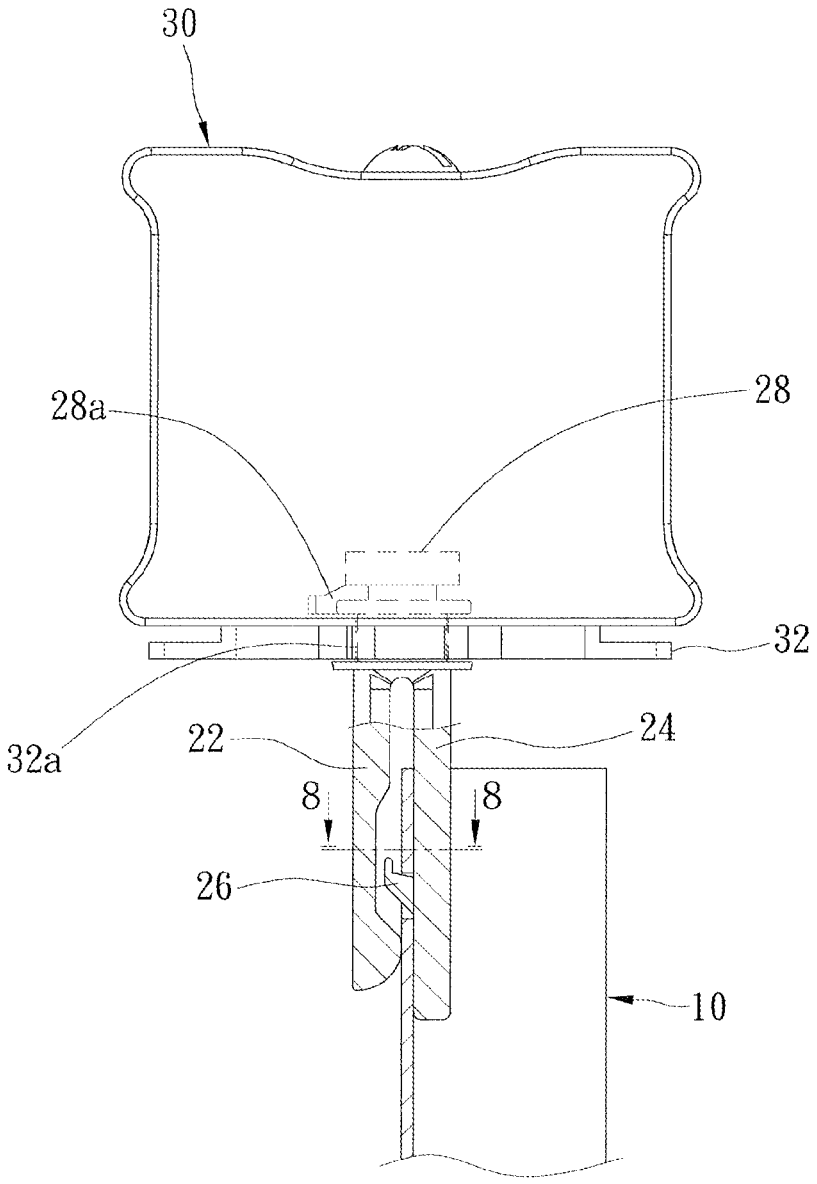
FIG. 5 is a sectional view of the vertical window blind of the first preferred embodiment of the present invention.

FIG. 4 and FIG. 5 show a vertical window blind of the first preferred embodiment of the present invention, including a head rail 30 and a plurality of vane assemblies 100. The head rail 30 is provided with a plurality of bases 32 on a bottom thereof, and the vane assemblies 100 respectively are connected to the bases 32. The bases 32 are slidable that the vane assemblies 100 may move along the head rail 30.

Each vane assembly 100 includes a vane 10 and a vane carrier 20. The vane 10 is vertical and has an elliptical bore 12 adjacent to top thereof. The bore 12 horizontally extends, and has two long and horizontal transverse edges 12*a* and two short and vertical lateral edges 12*b*, as shown in FIG. 9. A height H of the bore 12 is defined as a distance between the transverse edges 12*a*. The vane 10 has an arched cross-section, and has a concave side 14 as shown in FIG. 8.

Figure 7:
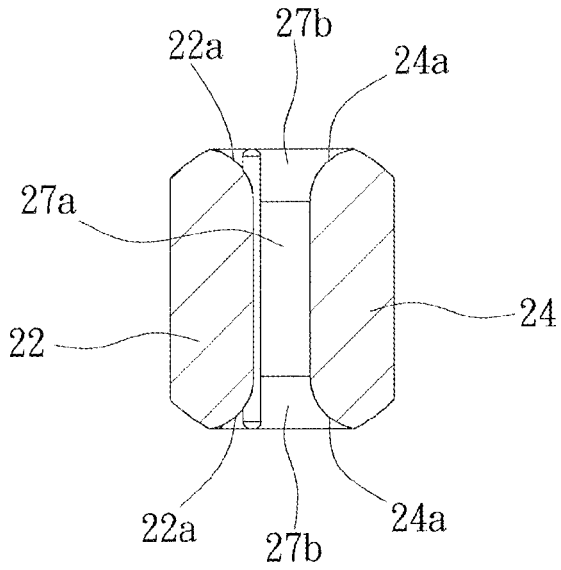
FIG. 7 is a sectional view along the 7-7 line in the FIG. 6.
Figure 8:
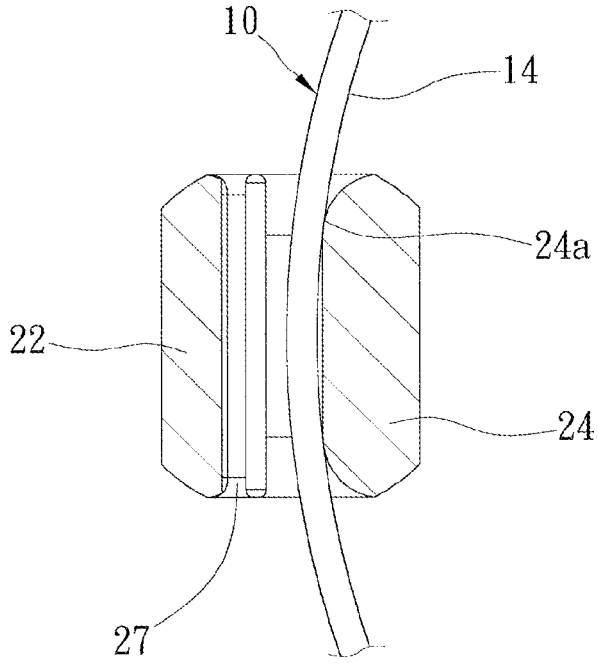
FIG. 8 is a sectional view along the 8-8 line in FIG. 5.
Figure 9:
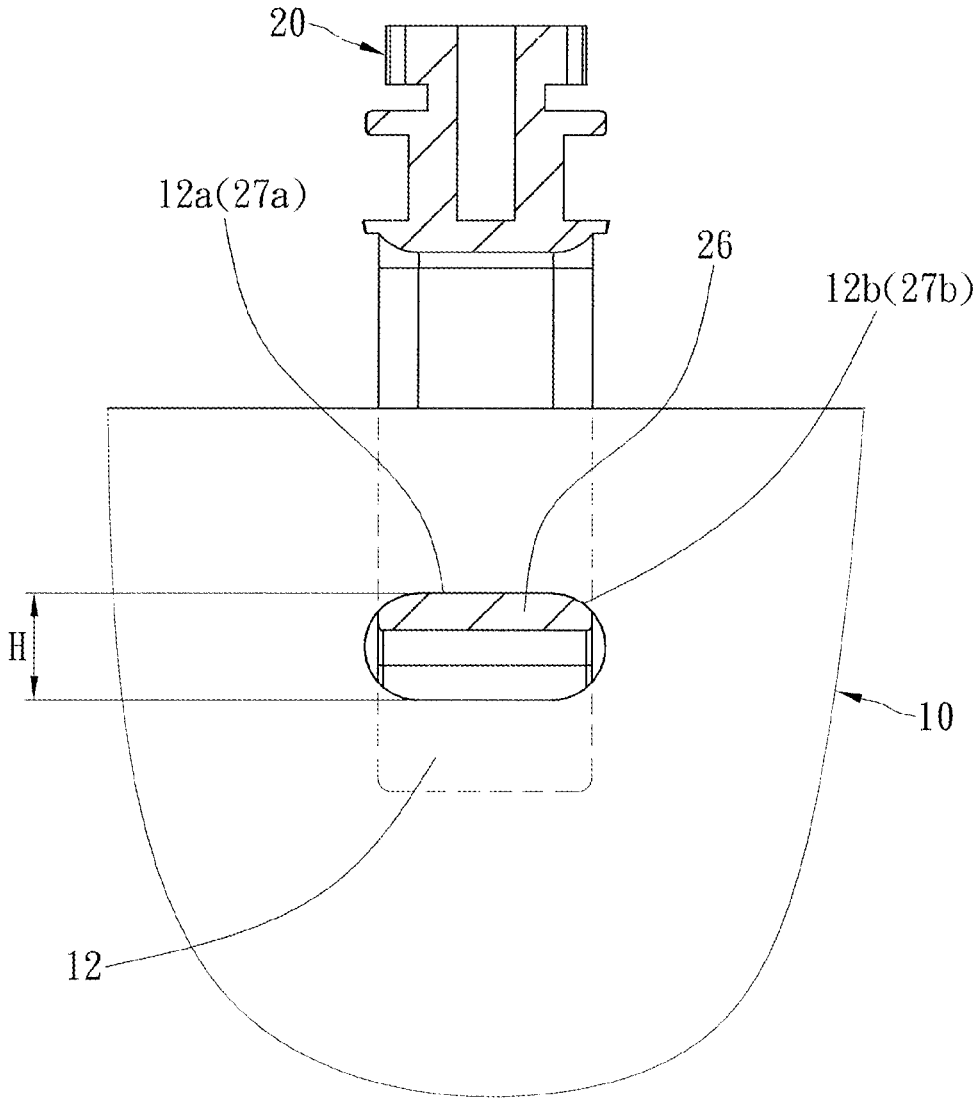
FIG. 9 is a sectional view of the vane assembly of the first preferred embodiment of the present invention.

32 As shown in FIGS. 7, 8, and 9, the vane carrier 20 has a front wall 22, a rear wall 24, and a hook 26.

Figure 6:
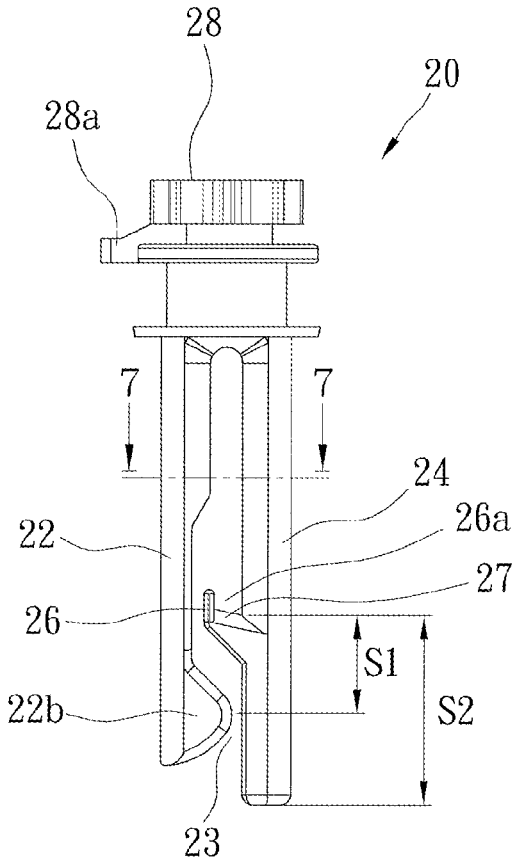
FIG. 6 is a lateral view of the vane carrier of the first preferred embodiment of the present invention.

The front wall 22 and the rear wall 24 are parallel and separated from each other. Top ends of the walls 22, 24 are connected to a head 28 (as shown in FIG. 6) that a clip slot 23 is formed therebetween. The head 28 is provided with a locker 28*a* extending along a radial direction. The front wall 22 and the rear wall 24 respectively have two curved corners 22*a* and 24*a*, and curvatures of the curved corners 22*a* and 24*a* fit the concave side 14 of the vane 10. As shown in FIG. 8, the curved corners 24*a* make the rear wall 24 without the sharp point, and the vane 10 has almost entire area attached to the rear wall 24. In such condition, any movement or swing of the vane 10 will not easily cause damage of the vane 10. The front wall 22 has a protrusion 22*b* on an inner side thereof adjacent to a free end thereof. The protrusion 22*b* and the rear wall 24 may clip the vane 10.

As shown in FIG. 5, the vane carrier 20 is connected to the base 32 by inserting the head 28 and the locker 28*a* into an elongated opening 32*a* on a bottom of the base 32, and turning the vane carrier 20 to let the locker 28*a* leave the opening 32*a*. In other words, the head 28 of the vane carrier 20 is engaged with the head rail 30 through the base 32 and is rotatable so that the vane carrier 20 may be turned between a lock position, in which the locker 28*a* leaves the elongated opening 32*a* to couple the vane carrier 20 to the base 32, and an unlock position, in which the locker 28*a* is moved to the elongated opening 32*a* to disengage the vane carrier 20 with the base 32.

The hook 26 is formed on the inner side of the rear wall 24, and has a slot 26*a* and a slot bottom 27. The hook 26 engages the bore 12 of the vane 10 to hang the vane 10. The slot bottom 27 slopes down towards the rear wall 24 that the vane 10 hung thereon moves to the rear wall 24 by gravity and is normally attached to the rear wall 24 to avoid unexpected movement of the vane 10. The slot bottom 27 includes a flat middle portion 27*a* and two curved portions 27*b* at opposite sides of the middle portion 27*a*. It is preferable that the configuration of the slot bottom 27 fits the bore 12 of the vane 10. Consequently, the flat middle portion 27*a* fits the top transverse edge 12*a*, and the curved portions 27*b* fit the corners between the top transverse edge 12*a* and the lateral edge 12*b*, as shown in FIG. 9. Therefore, the slot bottom 27 has the entire area attached to the edge of the bore 12 of the vane 10 so that there is no stress concentration on the vane 10 to avoid damage of the vane 10.

As shown in FIG. 6, the protrusion 22*b* is under the hook 26, and the distance S1 between the slot bottom 27 of the hook 26 and the protrusion 22*b* is greater than the height H of the bore 12 of the vane 10, which is shown in FIG. 9. Furthermore, a distance S2 between the slot bottom 27 of the hook 26 and a free end of the rear wall 24 is greater than or at least identical to the distance S1. As a result, the vane carrier 20 will turn along with the vane 10, and the head 28 will disengage the base 32 when the locker 28 turns to the opening 32*a* (the unlock position). As a result, the vane carrier 20 and the vane 10 drop from the base 32 instead of breaking the vane 10 when the vane 10 is over-turned by wind or unexpected force.

Figure 10:
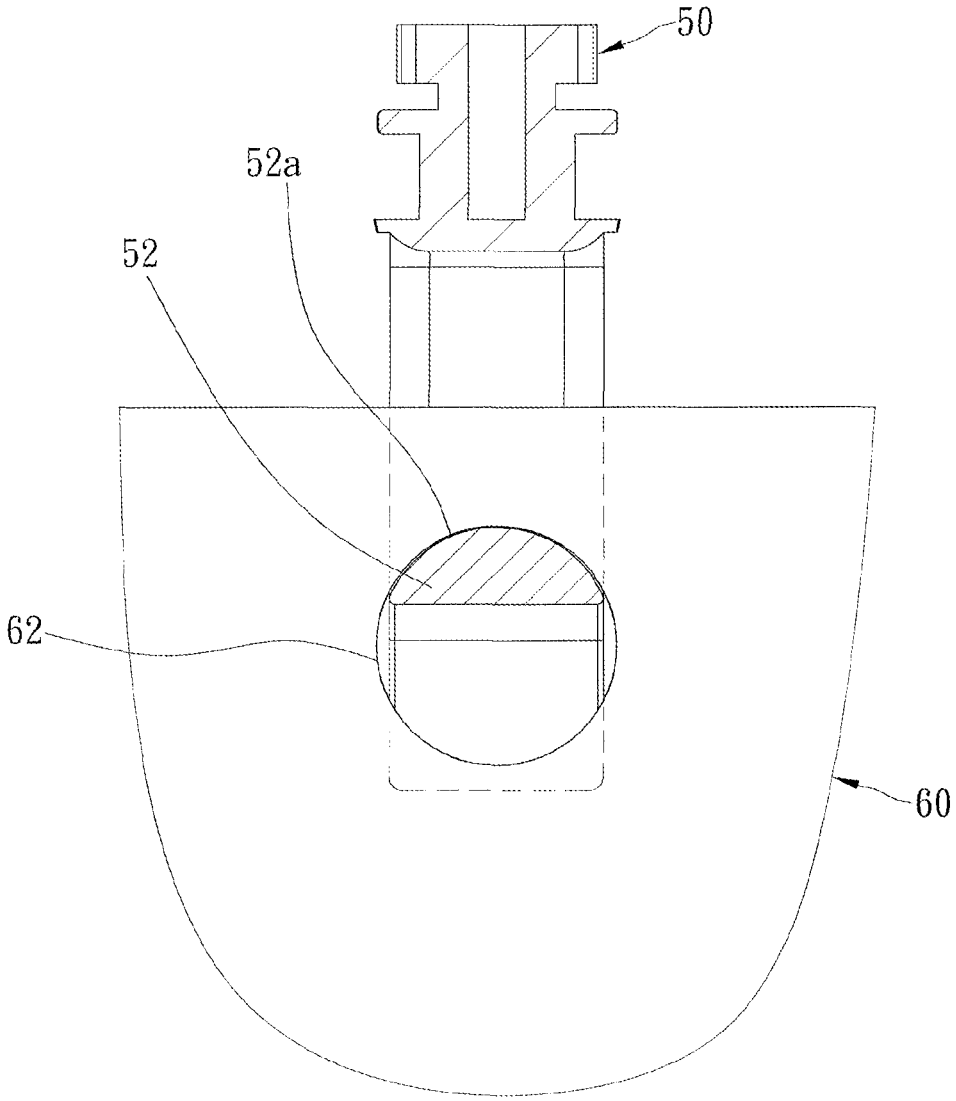
FIG. 10 is a sectional view of the vane assembly of a second preferred embodiment of the present invention.

FIG. 10 shows a vane assembly of the second preferred embodiment of the present invention. The same as above, the vane assembly has a vane carrier 50 and a vane 60 hung on a hook 52 of the vane carrier 50. The different part is that the hook 52 has an arched slot bottom 52*a* to fit a round bore 62 of the vane 60. It is preferable that a length of the arched slot bottom 52*a* is greater than one third of a circumference of the bore 62 that the hook 52 may stably hold the vane 60.

The description above is only a few preferred embodiments of the present invention and the equivalence of the present invention is still in the scope of claim construction of the present invention.

What is claimed is:

1. A vertical window covering, comprising:

a head rail having a plurality of openings which extend to a bottom of the head rail;

a plurality of vane carriers, each of which has a front wall, a rear wall, and a head connected to top ends of the front wall and the rear wall, wherein a clip slot is formed between the front wall and the rear wall, a hook is provided on the rear wall and in the clip slot, and the head is provided with a locker;

a hook, which is provided on the rear wall and is in the clip slot, having a slot and a slot bottom, wherein the slot bottom has a curved surface;

a plurality of vanes, each of which has a bore to engage the hook of the vane carrier;

wherein the curved surface of the hook is complementary to at least a portion of an edge of the bore of each of the plurality of vanes hung on the hook and wherein the slot bottom has a middle portion and two curved portions downward at opposite sides of the middle portion;

wherein the middle portion and each one of the two curved portions are directly connected to the rear wall; and wherein the head and the locker of the vane carrier is inserted into one of the opening of the head rail for rotation, and the vane carrier is turned between a lock position, in which the locker leaves the opening to couple the vane carrier to the head rail, and an unlock position, in which the locker is moved to the opening to disengage the head of the vane carrier with the opening of the head rail, and wherein at least one of the front wall and the rear wall is provided with two curved corners for engaging a vane having an arched cross section.

2. The vertical window covering as defined in claim 1, wherein the bore of the vane is elliptical, and the slot bottom of the hook has a middle portion and two curved portions at opposite sides of the middle portion to fit the edge of the bore.

3. The vertical window covering as defined in claim 1, wherein the vane carrier further has a protrusion on the front wall and under the hook, and a distance between the protrusion and the slot bottom of the hook is greater than a height of the bore of the vane.

4. The vertical window covering as defined in claim 2, wherein a distance between the slot bottom of the hook and a free end of the rear wall is greater than or identical to the distance between the protrusion and the slot bottom of the hook.

5. The vertical window covering as defined in claim 4, wherein the front wall has two curved corners.

6. The vertical window covering as defined in claim 1, wherein the bore of the vane is round, and the slot bottom of the hook contacts at least one third of the edge of the bore.

7. The vertical window covering as defined in claim 1, wherein head rail is provided with a plurality of bases, the openings respectively are provided on the bases.

8. The vane carrier as defined in claim 1, wherein the slot bottom of the hook has a curved surface.

9. The vane carrier as defined in claim 1, wherein the slot bottom of the hook slopes down towards the rear wall.

* * * * *